US006766951B2

(12) United States Patent
von Bismarck et al.

(10) Patent No.: US 6,766,951 B2
(45) Date of Patent: Jul. 27, 2004

(54) METHOD OF AND APPARATUS FOR MAKING COMPOSITE CONTAINERS WITH IDENTIFYING INDICIA

(75) Inventors: Gottfried von Bismarck, Hamburg (DE); Horst-Dieter Preuss, Glinde (DE); Ralf Grassmel, Hamburg (DE); Nikolaos Georgitsis, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/769,289

(22) Filed: Jan. 26, 2001

(65) Prior Publication Data

US 2001/0010332 A1 Aug. 2, 2001

(30) Foreign Application Priority Data

Jan. 28, 2000 (DE) ..... 100 03 674

(51) Int. Cl.[7] ..... G06K 7/00
(52) U.S. Cl. ..... 235/435; 235/439
(58) Field of Search ..... 235/435, 439, 235/462.01; 206/236, 459, 256

(56) References Cited

U.S. PATENT DOCUMENTS

| | | | | | |
|---|---|---|---|---|---|
| 4,077,289 | A | * | 3/1978 | Rudszinat | 83/152 |
| 4,281,670 | A | | 8/1981 | Heitmann et al. | 131/281 |
| 4,365,148 | A | * | 12/1982 | Whitney | 235/383 |
| 4,471,866 | A | | 9/1984 | Erdmann et al. | 198/419 |
| 4,677,552 | A | * | 6/1987 | Sibley, Jr. | 705/37 |
| 4,746,012 | A | * | 5/1988 | Simard | 206/254 |
| 4,784,261 | A | * | 11/1988 | Kutchin | 206/256 |
| 4,836,378 | A | * | 6/1989 | Lephardt | 206/459 |
| 5,135,008 | A | | 8/1992 | Oesterling et al. | 131/94 |
| 5,160,023 | A | * | 11/1992 | Adams et al. | 206/256 |
| 5,190,428 | A | * | 3/1993 | Bryant et al. | 414/403 |
| 5,365,596 | A | * | 11/1994 | Dante et al. | 382/8 |
| 5,427,235 | A | * | 6/1995 | Powell et al. | 206/245 |
| 5,542,529 | A | * | 8/1996 | Hein et al. | 206/245 |
| 5,806,281 | A | * | 9/1998 | Krul et al. | 53/412 |
| 5,823,528 | A | * | 10/1998 | Draghetti et al. | 271/270 |
| 6,223,895 | B1 | * | 5/2001 | Bowen et al. | 206/236 |
| 6,246,778 | B1 | * | 6/2001 | Moore | 382/103 |
| 6,456,729 | B1 | * | 9/2002 | Moore | 382/103 |

FOREIGN PATENT DOCUMENTS

| | | | |
|---|---|---|---|
| DE | 196 45 630 A1 | | 5/1998 |
| EP | 0 856 467 | | 8/1998 |
| EP | 905 027 A1 | | 3/1999 |
| JP | 11-198917 | * | 7/1999 |

* cited by examiner

*Primary Examiner*—Michael G. Lee
*Assistant Examiner*—Uyen-Chau N. Le
(74) *Attorney, Agent, or Firm*—Venable LLP; Robert Kinberg; Chad C. Anderson

(57) ABSTRACT

An apparatus for confining commodities in containers each of which consists of several components. The commodities are advanced along an elongated path past a series of stations where the components of the containers are draped around successive commodities. At least some of the components are provided with characteristic indicia, and a control circuit processes the indicia into information which is encoded upon the finished containers. Such information is decoded, when necessary, to ascertain the genuineness or lack of genuineness of the commodities, for example, the identity of the maker and packer of cigarettes in cigarette packs.

22 Claims, 4 Drawing Sheets

METHOD OF AND APPARATUS FOR MAKING COMPOSITE CONTAINERS WITH IDENTIFYING INDICIA

CROSS-REFERENCE TO RELATED CASES

The present application claims the priority of the commonly owned copending German patent application Serial No. 100 03 674.0 filed Jan. 28, 2000. The disclosure of the above-referenced German patent application, as well as that of each US and foreign patent and patent application identified in the specification of the present application, is incorporated herein by reference.

BACKGROUND OF THE INVENTION

The invention relates to improvements in methods of and in apparatus for making containers around one-piece or composite commodities, such as composite containers for confinement of rod-shaped, flowable and/or otherwise configurated, dimensioned, comminuted and/or assembled products of the tobacco processing industry. More particularly, the invention relates to improvements in methods of and in apparatus for making composite containers with identifying indicia. Typical examples of containers of the character to which the present invention pertains are so-called soft or hinged-lid cigarette packs wherein a composite container including parts made of paper, cardboard, metallic foil and/or plastic foil surrounds and confines an array or group of parallel rod-shaped plain or filter cigarettes or other rod-shaped smokers' products.

It is well known to assemble cigarette packs in a production line wherein a maker supplies plain or filter cigarettes to a packing machine which is designed to confine arrays of, e.g., twenty cigarettes each (often in so-called quincunx formations) first in inner envelopes often made of metallic foil, and to thereupon confine the thus obtained intermediate products in outer envelopes of paper, cardboard or a suitable plastic material. The thus obtained packs can be admitted into a so-called film wrapper which confines the packs in additional envelopes consisting of a transparent or translucent plastic sheet material. Such additional (outermost) envelopes are or can be provided with customary tear strips.

It was also proposed to provide parts of containers for groups or arrays of plain or filter cigarettes or the like with encoded information which renders it possible to ascertain whether or not the contents were made and packed by the manufacturer identified at the exterior of the container or by an imitator. Reference may be had, for example, to commonly owned copending U.S. patent application Ser. No. 09/671,585 filed Sep. 28, 2000 by Gottfried von BISMARCK for "METHOD OF AN APPARATUS FOR ASCERTAINING THE GENUINENESS OF PACKAGED COMMODITIES", and to commonly owned U.S. patent application Ser. No. 09/694,028 filed Oct. 23, 2000 by Gottified von BISMARCK for "METHOD OF AND APPARATUS FOR ENCODING AND RECORDING IDENTIFYING INDICIA FOR ARRAYS OF ROD-SHAPED ARTICLES".

OBJECTS OF THE INVENTION

An object of the present invention is to provide a novel and improved method of facilitating identification of the actual maker or makers of the contents of containers which confine one-piece, composite, flowable, particulate, filamentary or comminuted leaf-like and/or other types of commodities, e.g., in the form of parallelepiped blocks or the like.

Another object of the invention is to provide a novel and improved method of facilitating reliable detection of imitations of mass-produced commodities which are confined in containers of paper, cardboard, metallic foil and/or plastic foil.

A further object of the invention is to provide a novel and improved method of applying a variety of indicia to some or all constituents of envelopes or containers for smokers' products.

An additional object of the instant invention is to provide an apparatus for the practice of the above outlined method.

Still another object of the invention is to provide an apparatus which can be incorporated into or associated with existing machines or production lines for the making of filled containers in such a way that the genuineness of their contents can be ascertained in a simple, reliable and time-saving manner.

A further object of the invention is to provide an apparatus which can apply indicia to the constituents of composite containers for smokers' products or the like while such constituents are being made or assembled into containers around the commodities which are to be confined therein.

Another object of the invention is to provide a novel and improved combination of applicators of indicia for use in a production line for the making of containers confining products of the tobacco processing industry.

An additional object of the invention is to provide novel and improved containers for the confinement of a variety of commodities in such a way that the origins of the confined commodities can be ascertained with a high degree of accuracy and by resorting to available decoding instrumentalities.

Still another object of the invention is to provide a group of machines for the mass production of packaged smokers' products which embodies or is associated with the above outlined apparatus.

SUMMARY OF THE INVENTION

One feature of the present invention resides in the provision of a method of confining a commodity (e.g., an array of twenty plain or filter cigarettes in the so-called quincunx formation) in a composite container having a plurality of constituents (including, for example, envelopes of metallic foil, paper or cardboard and plastic foil, and an insert of paper or cardboard). The method comprises the steps of assembling the constituents into the container around the commodity, providing at least some of the constituents with characteristic indicia not later than in the course of the assembling step, processing the characteristic indicia into information (e.g., a numeral) which is characteristic of the assembled container, and encoding the thus obtained information upon at least one constituent of the container.

The providing step can include randomly selecting at least one of the characteristic indicia; for example, each such indicium can be a numeral consisting of one or more digits, one or more letters and/or a combination of letters and digits.

The providing step can include applying all of the characteristic indicia to the respective constituents of the container prior to the assembling step.

The encoding step is or can be carried out prior to the assembling step, and the providing step can include applying at least one of the characteristic indicia to the respective constituent of the container in the course of the assembling step. Such encoding step can include applying the information to the at least one constituent of the container prior to completion of the assembling step.

In accordance with a presently preferred embodiment, the at least one constituent is accessible for the application of encoded information, at least in part, upon completion of the assembling step. The encoded information can be of such nature and can applied in such a way that it is decodable without necessitating even partial opening of the assembled container.

The constituents of the container can include an inner envelope directly surrounding the commodity in the assembled container, an outer envelope which surrounds the inner envelope when the assembling step is completed, an insert which is disposed between the inner and outer envelopes of the assembled container, a light-transmitting outermost envelope which surrounds the outer envelope of the assembled container, and a tear strip which is or can be carried by the outermost envelope. The providing step of the method which involves the making of a container from the above five constituents can include applying indicia to each of the inner, outer and outermost envelopes as well as to the insert and to the tear strip. The assembling step of such method can include confining the commodity in the inner envelope, thereupon applying the insert around a selected part of the inner envelope, thereafter confining the inner envelope and the insert in the outer envelope, and thereafter applying the outermost envelope (preferably with the tear strip on the outermost envelope) around the outer envelope.

The assembling step can include advancing the commodity along a predetermined path and draping the constituents of the container around the advancing commodity in a predetermined sequence in successive portions of the path.

The method can further comprise the step or steps of processing into the information data pertaining to at least one of (a) the commodity and (b) the container. Such data can denote at least one of (i) the time of the assembling step (ii) the location of the assembling step, and (iii) at least one person in charge of the assembling step.

It is often advisable to resort to an encoding step which involves visibly applying the information to an exposed part of the at least one constituent of the assembled container.

Another feature of the instant invention resides in the provision of an apparatus for confining successive ones of a series of commodities (such as the aforementioned arrays of plain or filter cigarettes or other rod-shaped products of the tobacco processing industry) in composite containers each of which has a set of, for example, five constituents. The apparatus comprises means for conveying successive commodities of the aforementioned series of commodities along a predetermined elongated path, means for assembling the constituents of the sets into containers, including means for placing the constituents around successive commodities in a predetermined sequence in successive portions of the path, means for providing at least some constituents of each set with characteristic indicia not later than in the respective portions of the path, means for processing the characteristic indicia of the at least some constituents of each set into information which is characteristic of the respective assembled containers, and means for encoding the information upon the respective containers.

At least some of the characteristic indicia can constitute randomly selected indicia (such as multidigit numerals and/or groups of letters).

The assembling means can comprise a cigarette packing machine, a carton packing machine or the like.

The means for providing at least some of the constituents with characteristic indicia can comprise at least one laser and/or at least one printer.

If the constituents of each set include a first blank which is convertible into an inner envelope of a container, a second blank which is convertible into an outer envelope of a container, a third blank which is convertible into an outermost envelope of a container, and an insert which is convertible into a collar between the inner and outer envelopes, the means for providing characteristic indicia can include a first laser for the application of indicia to first blanks, a second laser for the application of indicia to second blanks, a first printer for the application of indicia to inserts, and a second printer for the application of indicia to third blanks. The encoding means of such apparatus can include a laser. Apparatus of the just outlined character can constitute or include a cigarette packing machine.

The constituents of each set can further include a tear strip which is borne by the respective third blank, and the second printer can be arranged to apply indicia to the tear strips.

The just described apparatus can further comprise additional conveying means for delivering the blanks and the inserts to the respective portions of the path.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
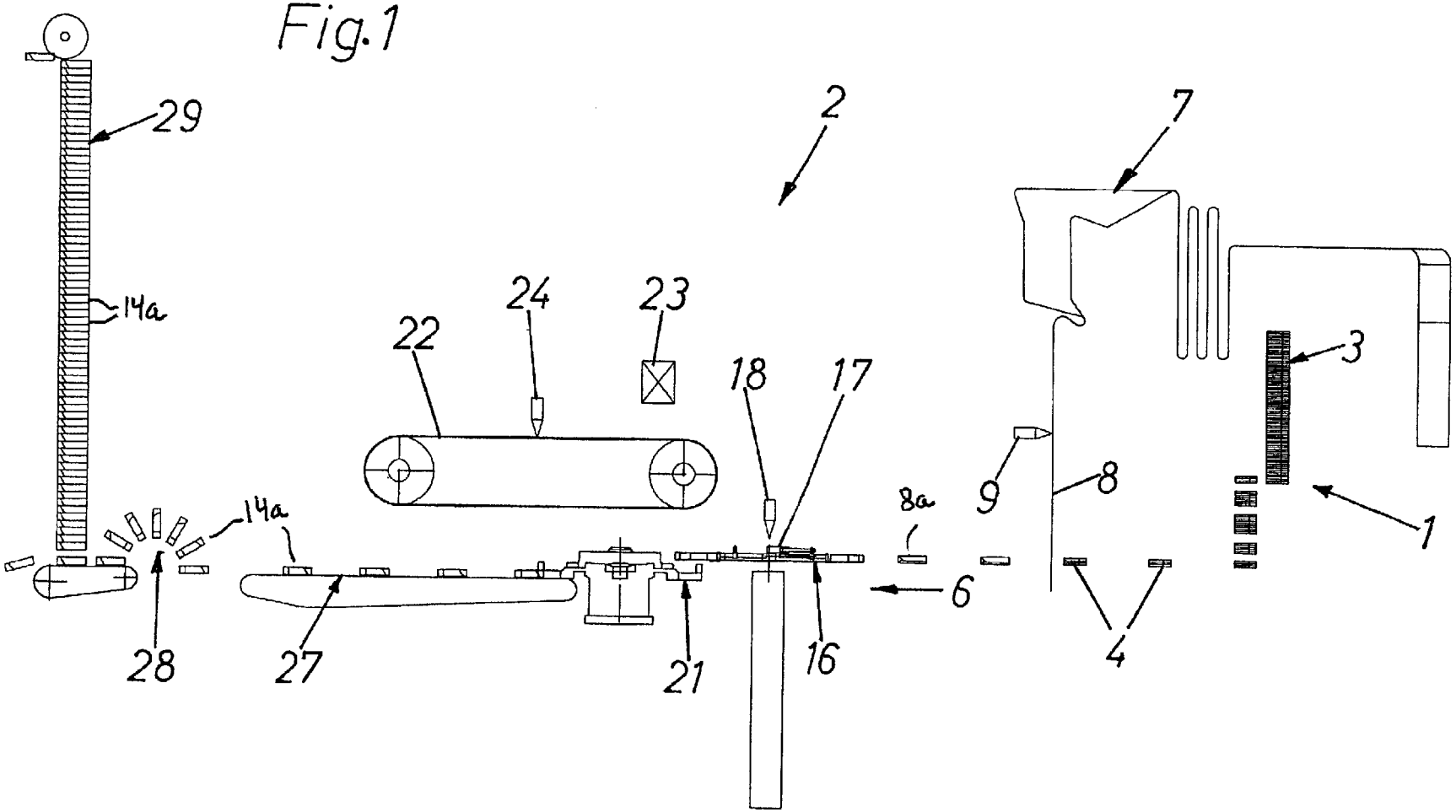
FIG. 1 is an exploded fragmentary schematic elevational view of a packing machine which turns out packs of arrayed rod-shaped smokers' products and wherein certain constituents of the composite containers of successive packs are provided with identifying indicia in accordance with one presently preferred embodiment of the invention.
Figure 4:
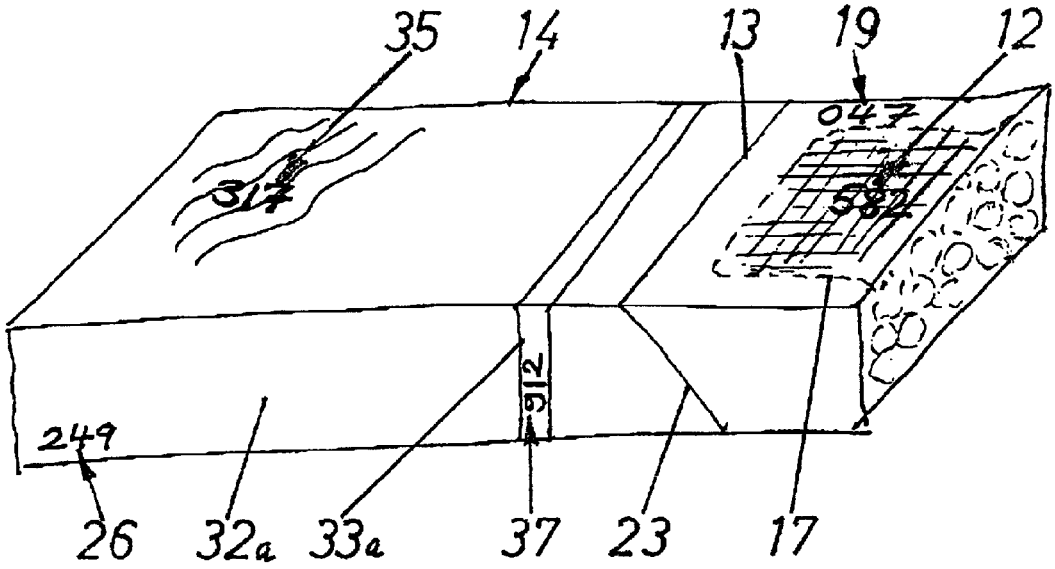
FIG. 4 is a perspective view of a finished hinged-lid pack and further shows the locations of indicia on various constituents of the container which confines an array of rod-shaped smokers' products.
Figure 5:
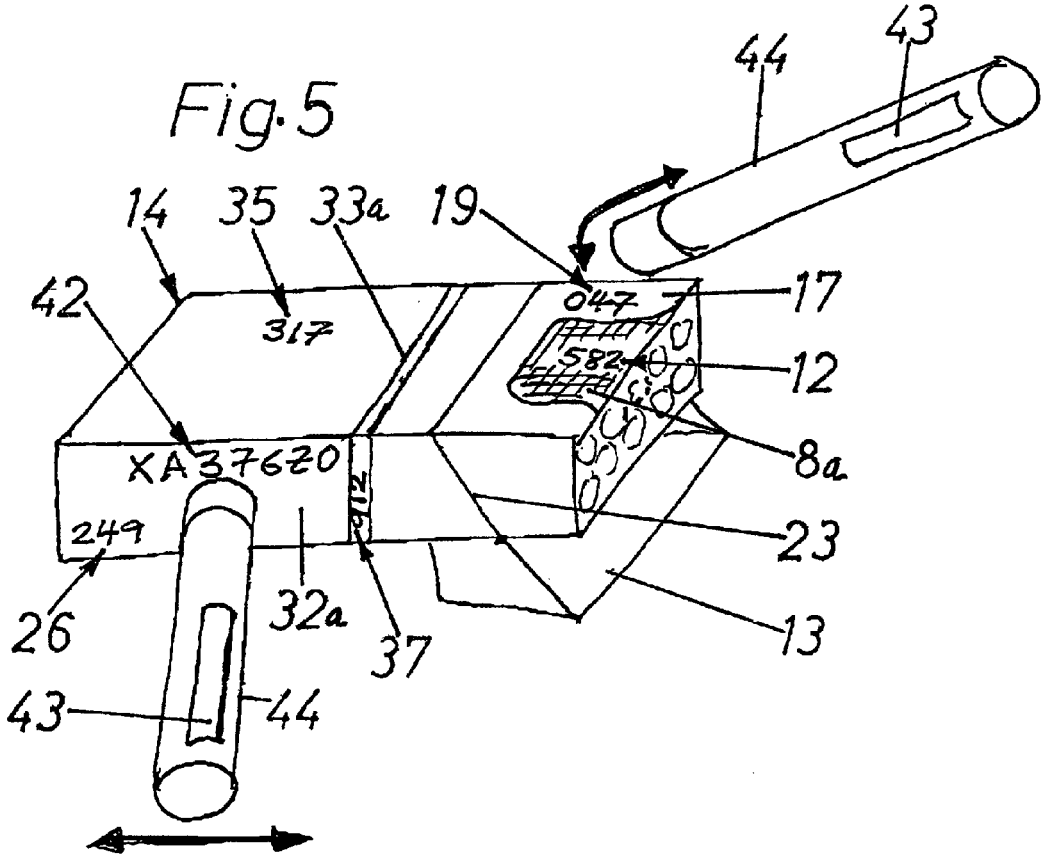
FIG. 5 shows the pack of FIG. 4 but with the lid of the pack pivoted to open position and further showing two implements for the decoding of indicia applied to the constituents of the envelope forming part of the pack.

FIG. 1 illustrates a portion of a production line which serves to turn out cigarette packs 14 of the type shown in detail in FIGS. 4 and 5 and known as hinged-lid packs. That portion of the production line which is shown in FIG. 1 constitutes a packing machine 2 including an arraying or group forming unit 1 having a series of upright ducts 3 forming part of a magazine which receives plain cigarettes from a maker, e.g., from a machine known as PROTOS which is distributed by the assignee of the present application, or filter cigarettes from a filter cigarette maker (called tipping machine), e.g., from a machine known as MAX also distributed by the assignee of the present application.

A machine for making plain cigarettes is disclosed, for example, in U.S. Pat. No. 4,281,670granted to Heitmann et al. on Aug. 4, 1981 for "APPARATUS FOR INCREASING THE PERMEABILITY OF WRAPPING MATERIAL FOR ROD-SHAPED SMOKERS' PRODUCTS". A machine for making filter cigarettes is disclosed, for example, in commonly owned U.S. Pat. No. 5,135,008 granted to Oesterling et al. on Aug. 4, 1992 for "METHOD OF AND APPARATUS FOR MAKING FILTER CIGARETTES". An apparatus or unit which can receive plain cigarettes from the cigarette maker of Heitmann et al. or filter cigarettes from the tipping machine of Oesterling et al. to assemble such rod-shaped articles into commodities 4 (here shown as arrays or groups of, for example, twenty cigarettes each in the so-called quincunx formation) is disclosed, for example, in U.S. Pat. No. 4,471,866granted to Erdmann et al. on Sep. 18, 1984 for "APPARATUS FOR ASSEMBLING ARRAYS OF CIGARETTES IN PACKING MACHINES".

The ducts 3 of the unit 1 disclosed, for example, in the '866 patent to Erdmann et al. discharge commodities or arrays 4 into the pockets of a suitable conveyor (e.g., a belt or chain conveyor) which advances successive arrays along an elongated path in the direction indicated in FIG. 1 by the arrow 6. The pockets with arrays 4 therein advance into the next-following unit or station of the packing machine 2 wherein the first wrapping or packing step includes confining successive arrays 4 in inner envelopes consisting of metallic foil (such as tinfoil).

A conveyor 7 serves to advance a continuous web or strip 8 of metallic foil past a first indicia providing and applying device 9 (e.g., a laser) which provides spaced-apart sections of the running web 8 with characteristic indicia 12 (e.g., with three-digit numerals one of which is shown (at 582) in FIGS. 4 and 5). The leader of the web 8 is repeatedly severed downstream of the laser 9 to yield a series of discrete blanks 8*a* which are draped around successive commodities or arrays 4 to constitute the inner envelopes of the containers of incipient cigarette packs.

Each incipient pack (consisting of an array 4 and an inner envelope constituted by a converted blank 8*a*) is thereupon introduced into one of an annulus of receptacles forming part of a conveyor 16 here shown as a turntable which is indexible about a vertical axis. Each receptacle which enters the path of successive incipient packs already contains a converted insert or collar 17 which is a standard part of a hinged-lid cigarette pack and straddless a selected portion of the inner envelope (converted blank 8*a*) in the respective pocket of the turntable 16. A second indicia applying device 18 (e.g., a printer) is provided to apply to successive collars 17 second characteristic indicia 19 one of which is shown in each of FIGS. 4 and 5. Each indicium 19 can constitute a three-digit numeral (such as the numeral 047 shown in each of FIGS. 4 and 5) which is confined within the hinged lid 13 of the outer envelope of a finished pack 14.

The various implements or tools which are used to repeatedly sever the leader of the continuously running or intermittently advancing web 8, to fold the blanks 8*a* around the arrays 4 and to perform additional folding, severing, tucking, creasing, flexing, adhesive applying, inserting, expelling and other tasks, while successive arrays 4 advance toward, through and beyond the packing machine 2 are not specifically shown in the drawings because the exact design of such tools or implements forms no part of the present invention. Thus, save for the laser 9, printer 12 and other indicia applicators (which will be fully described hereinafter), the construction and the mode of operation of the production line including the packing machine 2 and its arraying unit 1, as well as the cellophaning machine 31 shown in FIG. 2, form no part of the present invention.

Figure 3:
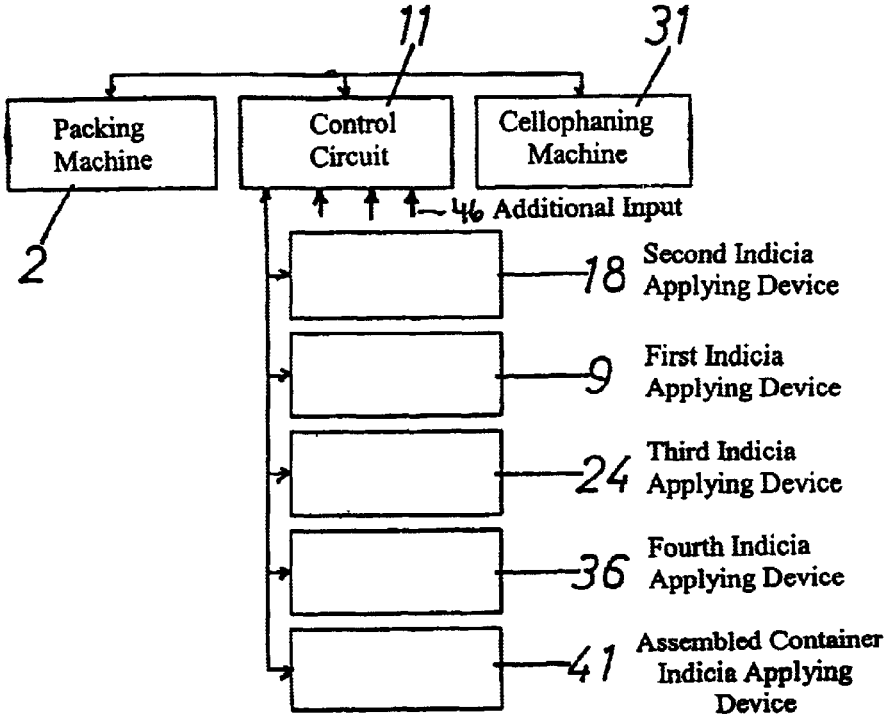
FIG. 3 is a flow chart showing the manner in which signals are being transmitted between a control circuit and five indicia applying devices as well as between the control circuit and certain additional sources of information to be processed for the transmission of information being encoded on the finished containers of successive packs.

FIG. 3 shows schematically a processing or control circuit 11 (e.g., an apparatus including or constituting a computer) which can receive signals from and/or transmit signals to the packing machine 2, the cellophaning machine 31 and numerous indicia providing and applying devices including the aforementioned laser 9 and printer 18. The purpose of the control circuit 11 is to transmit to the indicia providing and applying devices signals at required intervals and in a required sequence to thus ensure that each selected part of a finished composite container receives a requisite number of indicia on predetermined constituents of each container as well as on preselected portions of the respective constituents. Thus, the control circuit 11 ensures that each blank 8*a* has a predetermined size (i.e., that the web 8 is severed at requisite intervals) and that the indicia 12 are applied to the web 8 in such a way that the indicium 12 borne by a blank 8*a* is not confined or concealed by the respective converted insert (collar) 17 (see FIG. 5). Analogously, the control circuit 11 ensures that the printer 18 provides an indicium on a predetermined portion of the converted insert (collar) 17, e.g., next to the indicium 12 borne by the respective converted or folded or draped blank 8*a*. This, too, can be seen in FIG. 5. The characteristic indicia 12 and 19 are concealed (see FIG. 4) when the flap or lid 13 is held in the operative (closing or overlapping) position.

The second conveyor or turntable 16 can be of the type disclosed, for example, in published European patent application Serial No. 0 856 467. This application further discloses one presently preferred mode of supplying and applying prefabricated collars (converted inserts) 17 into the pockets of the turntable 16.

The aforementioned published European patent application Serial No. 0 856 467 further discloses a linear conveyor corresponding to the conveyor 27 shown in FIG. 1 and having a substantially horizontal upper reach serving to receive partially finished packs 14*a* from a further turntable 21. The latter is associated with implements serving to convert the incipient packs furnished by the turntable 16 into partly finished packs 14*a*. Each partly finished pack 14*a* comprises an array 4, an inner envelope (converted blank) 8*a* immediately surrounding the array 4, a collar 17 which surrounds a predetermined portion of the inner envelope, and an outer envelope which can consist of lightweight cardboard and constitutes a converted blank 23. The blanks 23 are supplied by an endless belt or chain conveyor 22 which advances successive blanks 23 of a series of such blanks past a third indicia applying device 24. The latter applies characteristic indicia 26, e.g., three-digit numerals one (249) of which is shown in FIGS. 4 and 5.

Each indicium 26 is applied to a narrow lateral panel of the respective converted blank 23. This is shown in FIGS. 4 and 5. The blanks 23 include portions which are converted into the hinged lids 13 of the finished outer envelopes. Each partly finished pack 14*a* which leaves the turntable 21 as a result of transfer onto the upper reach of the endless conveyor 27 includes an inner envelope (converted blank 8*a*) with an indicium 12, a collar (converted insert) 17 with an indicium 19, and an outer envelope (converted blank 23) which latter carries a characteristic indicium 26.

The device 24 which provides successive blanks 23 with indicia 26 can include or constitute a laser which receives signals from the control circuit 11 of FIG. 3, always at intervals which are required to ensure that the indicia 26 ultimately occupy predetermined positions when the conversion of the respective blanks 23 into the outer envelopes of the partly finished packs 14*a* is completed. The indicia 26 need not be applied in a manner to ultimately assume the positions shown in FIGS. 4 and 5, i.e., at the end of a pack 14 remote from the hinged lid 13.

The belt or chain conveyor 27 can serve as a means for ensuring adequate drying of the films of adhesive which has been applied to the blanks 23 on the conveyor 22, ahead of the conveyor 22 and/or on the turntable 21. Such adhesive is needed to ensure that the overlapping panels or walls of the outer envelope of the partly finished pack 14*a* and of its hinged lid 13 properly (reliably) adhere to each other during advancement of the partly finished packs 14*a* toward and through the cellophaning machine 31 of FIG. 2.

The conveyor 27 delivers successive partly finished and at least partially dried packs 14*a* into the range of a transfer conveyor or unit 28 which delivers the packs 14*a* into an upright magazine 29. The latter stores at least one pile or stack of packs 14*a* prior to admission into the cellophaning machine 31. The transferring or admitting step is performed by a conveyor 30 which admits successive packs 14*a* into successive radially extending pockets of a folding conveyor or unit 38 which is indexible about a horizontal axis.

Each partially finished pack 14*a* which enters a pocket of the folding unit 38 engages and entrains a blank 32*a* which is obtained as a result of repeated severing of the leader of a continuously or intermittently advancing web or strip or band of cellophane or an analogous transparent or translucent plastic material. The web 32 is drawn from a source 132 and is trained over a series of rollers, pulleys, wheels and/or other suitable conveying and/or guiding elements 34.

Figure 2:
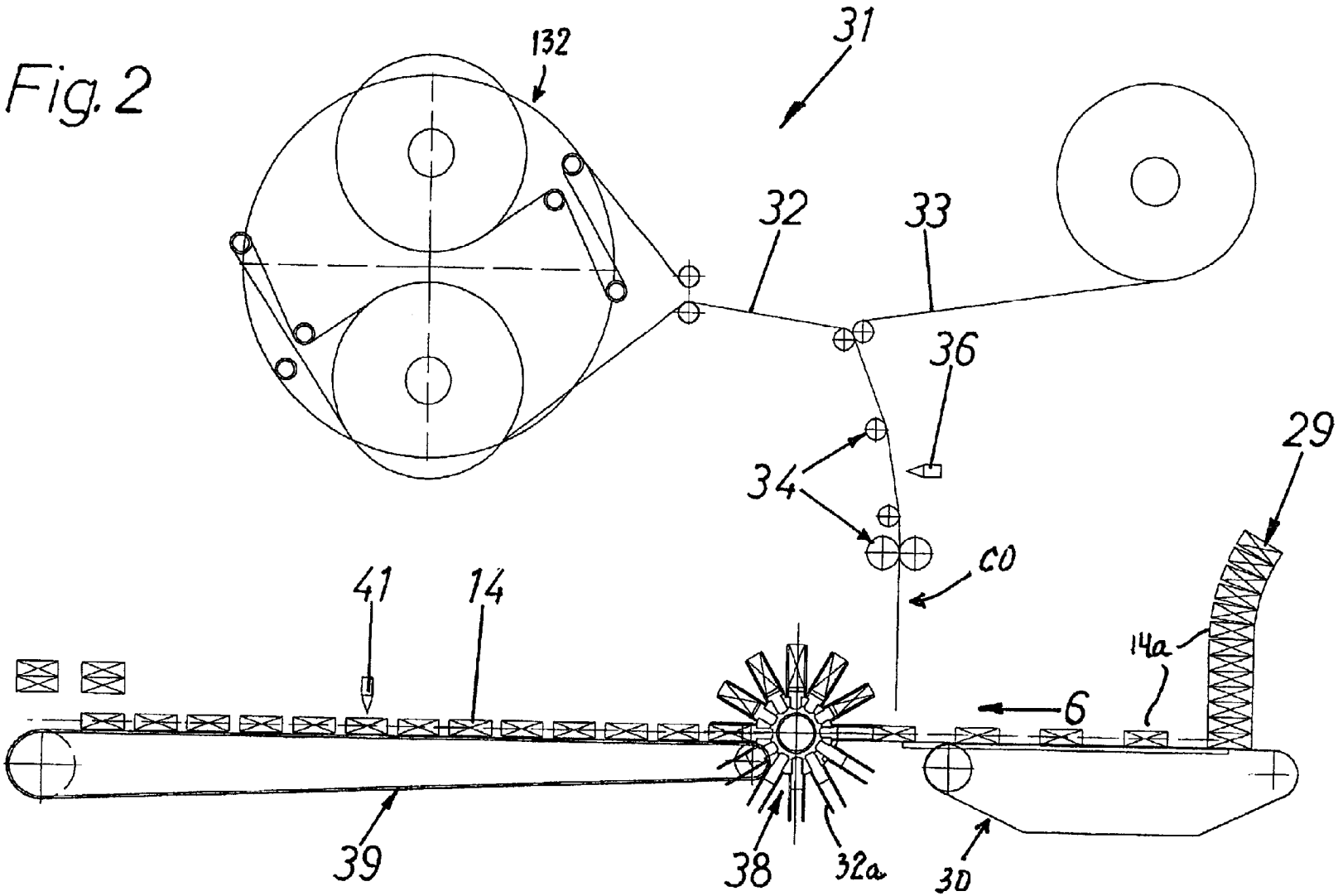
FIG. 2 is a similar exploded fragmentary schematic elevational view of a cellophaning machine forming part of the production line and having means for applying indicia to additional constituents of the composite containers for partly finished packs received from the packing machine of FIG. 1.

The cellophaning machine 31 of FIG. 2 is or can be of the type known as C 90 film wrapper which is distributed by the assignee of the present application; this machine is further arranged to apply to one side of the web 32 a continuous tear strip or tape 33 one side of which is coated in part with a suitable adhesive serving to bond selected portions of the tear strip 33 to the adjacent portions of the web 32. It is also possible to weld the tear tape 33 to the web 32. The latter is severed at regular intervals by a so-called cutoff (not shown) ahead of the folding unit 38 so that the web 32 yields a series of blanks 32*a* each of which carries a tear strip 33*a* (see FIGS. 4 and 5) of finite length. The blanks 32*a* which are propelled into the pockets of the indexible folding unit 38 are converted into the transparent or translucent outermost envelopes of composite containers of the finished packs 14.

On its way toward the aforementioned cutoff (this cutoff can be installed at the locus indicated by the arrow CO shown in FIG. 2), the web 32 and the (still) continuous tear strip or tape 33 advance past a further indicia applying device 36 (e.g., a printer) which applies printed matter 35 (FIGS. 4 and 5 show a three-digit numeral 317) to the web 32 and which also applies printed matter (indicia) 37 (FIGS. 4 and 5 show a three-digit numeral 912) to the adjacent portion of the (still) continuous tear strip or tape 33. The timing of application of printed characteristic indicia 35, 37 by the device 36 is controlled by the circuit 11.

The folding unit 38 delivers successive finished packs 14 onto the upper reach of an endless belt or chain conveyor 39 which advances such finished packs seriatim past a further indicia or information applying device 41, e.g., a laser which applies information 42 shown in FIG. 5. Such information is applied to a narrow elongated lateral panel or wall of the outermost envelope (converted cellophane blank 32*a*) and/or to the respective portion or wall or panel of the outer envelope (converted blank 23).

The information 42 which is shown in FIG. 5 constitutes encoded (cryptographic) information which is furnished to the laser 41 by the control circuit 11 of FIG. 3 and is a product or sum or another derivation of characteristic indicia 12, 19, 26, 35 and 37 applied to the selected parts or constituents of the container (consisting of a converted blank 8*a*, a collar (converted insert) 17, a converted blank 23, a converted blank 32*a* and the respective portion 33*a* of the tear strip or tape 33) by the laser 9, printer 18, laser 24 and printer 36. Each of the encoded composite information or indicia 42 is characteristic of the respective cigarette pack 14 and its container.

In order to compare and to ascertain the accuracy of association of the indicia 12, 19, 26, 35, 37 with the respective constituents 8*a*, 17, 23, 32*a*, 33*a* of the tested packs 14 and with the encoded information 42, one can resort to a decoding implement or instrument 44 which is provided with a display 43. Two such decoding instruments are shown in FIG. 5. The lower left-hand decoding instrument is shown in the process of decoding one of the indicia 26, 35, 37, 42 which can be decoded while the finished pack 14 is still intact. The indicia 12 and 19 can be interpreted by an instrument 44 (see the instrument in the upper right-hand portion of FIG. 5) after the outermost envelope (converted blank 32*a*) is removed at least to an extent which is necessary to enable the person seeking to decode the indicia 12, 19 to pivot the hinged lid 13 to its open position shown in FIG. 5. It will be seen that the gaining of access to the indicia 12 and 19 does not necessitate any special manipulation of the finished pack 14, i.e., it is merely necessary to proceed in a manner which is required to gain access to the contents (cigarettes of the array 4) confined in the inner envelope (converted blank 8*a*) of the pack 14.

The means 9, 24, 41 which are being resorted to in order to provide the indicia 12, 26, 42 can be conventional so-called inscribing lasers, e.g., lasers distributed by the German Firm IWK Verpackungstechnik GmbH. The information 42 is preferably applied by a laser which is distributed by the Firm Domino Laser Inc. This laser is designed to transfer some material from the outer side of the converted blank 23 to the inner side of the adjacent portion of the transparent or translucent outermost envelope (converted blank 32*a*).

The nature of the characteristic indicia 12, 19, 26, 35, 37 is or can be such that the encoded information 42 appears only once. In other words, if an exact replica of the once decoded information 42 is located by resorting to an implement 44 or in any other suitable way, this is indicative of the contents (array 4) furnished or manufactured and packed by a party other than that whose name (or whose distributor's name) appears at the exterior of the finished pack 14, normally at the exterior of the converted blank 23.

It is desirable to calibrate or to ascertain the accuracy of the decoding instruments) 44 at regular intervals. This is an undertaking which even further enhances the ability of the employed decoding instrument or instruments to reliably detect and indicate the genuineness or lack of genuineness of the finished packs 14.

At least some of the characteristic indicia 12, 19, 26, 35, 37 preferably vary from pack to pack. For example, each of these indicia can be selected by the respective device 9, 18, 24, 36 in random fashion. The control circuit 11 is designed in such a way that the information 42 encoded by the device 41 varies from pack to pack (14).

The indicia 12, 19, 26, 35, 37 can constitute encoded or non-encoded information; for example, the illustrated indicia 12, 19, 26, 35 and/or 37 can be replaced with indicia in bar code without departing from the spirit of the present invention. Furthermore, the device 9, 18, 24 and/or 36 can be designed to apply the respective indicia 12, 19, 26, 35, 37 in the form of printed matter, optically by a laser, magnetically, electrically (by changing the conductivity of selected portions of the respective components (8*a*, 17, 23, 32*a*, 33*a*) of the containers of the packs 14) and/or in any other suitable manner. The applied indicia may but not be visible to the naked eye.

The exact design of the control or processing circuit 11 forms no part of the present invention. All that counts is to employ a control circuit which can transmit signals to the devices 9, 18, 24 and 36 at the required frequency and which can process signals received from or transmitted to at least some of the devices 9, 18, 24, 36 in a manner to enable the device 41 to apply information 42 associated only with the respective pack 14.

It is also within the purview of the invention to apply the information 42 or its equivalent to a component part of the container (such as the container including converted blanks 8*a*, 23, 32*a* (with or without the tear strip 33*a*) and the collar (converted insert) 17) which can be monitored by an instrument 44 or the like only upon at least partial opening (such as destruction) of at least one envelope of the respective pack 14.

Still further, it is possible to omit the devices 9, 18 and to employ only devices which apply indicia to those parts of a container which can be inspected by an instrument or implement 44 or the like from the outside without necessitating any, even partial, opening of the container.

It is further possible to even more reliably encode the information which is applied by the device 41 or its equivalent(s), namely to furnish to the control circuit 11 additional information which is utilized in connection with the transmission of information to the laser 41 or an equivalent device for the application of the encoded information 42. FIG. 3 shows that the control circuit 11 is provided with several additional inputs 46 (i.e., with one or more inputs in addition to those which supply information from the printing machine 2, from the cellophaning machine 31 and from the devices 9, 18, 24 and 36) for information which can denote the date or time of the making of the cigarettes of the respective array 4 or the respective container for the array, the locale of the plant in which the cigarettes of the groups or arrays 4 and/or the packs 14 are being made, the operator (s) of the production line including the machines 2 and 31 and/or others. Such information can be encoded with that furnished to the control circuit 11 by the lasers 9, 24 and printers 18, 36 to be processed together with the information furnished by way of one or more inputs 46. This enables the instrument(s) 44 or its or their equivalent(s) to carry out a plausibility analysis going beyond that which is possible by analyzing only the information represented by the indicia 12, 19, 26, 35 and 37.

It is further clear that the indicia 12, 19, 26, 35 and 37 need not be applied in on-line operation. For example, the indicium 12 can be applied to longitudinally spaced-apart portions or sections of the web 8 ahead of or at the conveyor 7, and the same holds true for the application of indicia 19 to the inserts (future collars) 17 and/or for the application of indicia 26 to the blanks 23 or to the cardboard or other material of which the blanks 23 are being made.

An important advantage of the improved method and apparatus is that no information must be encoded upon or in the contents (arrays 4) of the containers forming part of the finished packs 14. This greatly reduces the cost of the production line and renders it possible to decode the information 42 or its equivalent without it being necessary to scan the confined commodities (arrays) 4.

Another important advantage of the improved method and apparatus is that it is possible to detect the presence of genuine products or unauthorized imitations in a number of different ways, such as by comparing the loci of application of the indicia 12, 19, 26, 35 and/or 37, the qualities of the applied characteristic indicia, the nature of the applied indicia and/or many other parameters. This renders it possible to rapidly, reliably and repeatedly ascertain the genuineness or lack of genuineness of the contents of the successively or randomly (such as sporadically) tested packs 14 with one or more commercially available implements or instruments (44) and/or in any other suitable way.

It goes without saying that the application of characteristic indicia and encoded information to and the decoding of encoded information on cigarette packs (14) constitutes but one of numerous utilizations of the improved apparatus and but one of numerous resorts to the method of the present invention. For example, the improved method and apparatus can be resorted to in connection with the making of so-called cartons each of which can contain ten cigarette packs (e.g., two superimposed layers of five packs each). A machine which can be equipped with the improved apparatus is known as B 90 cigarette pack boxer (distributed by the assignee of the present application). Such machine can be employed to carton hinged-lid packs of the type shown in FIGS. 4 and 5 or so-called soft packs. Another machine which can be equipped or associated with the improved apparatus is that known as CP 90 case packer (distributed by the assignee of the present application); such machine can confine cartons (each of which can contain, for example, ten cigarette packs) in boxes each of which can accommodate, for example, twentyfive cartons. Still further, the improved method and apparatus can be resorted to with equal or similar advantage in connection with the ascertainment of genuineness or lack of genuineness of commodities other than those being turned out by the tobacco processing industry.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of ascertaining the genuineness of the contents of containers for cigarettes and the like and, therefore, such adaptations should and are intended to be comprehended within the meaning and range of equivalence of the appended claims.

What is claimed is:

1. A method of confining a commodity in one of a plurality of composite containers having a plurality of constituents, comprising the steps of:

assembling the constituents into the composite container around the commodity providing at least some of the constituents with characteristic indicia not later than in the course of the assembling step;

processing the characteristic indicia into information which is characteristic of each individual assembled container; and encoding the information upon at least one constituent of the container.

2. The method of claim 1, wherein said providing step includes randomly selecting at least one of the characteristic indicia.

3. The method of claim 1, wherein said providing step includes applying all of the characteristic indicia to the respective constituents prior to the assembling step.

4. The method of claim 1, wherein said encoding step is carried out subsequent to said assembling step.

5. The method of claim 1, wherein said providing step includes applying at least one of the characteristic indicia to the respective constituent of the container in the course of said assembling step.

6. The method of claim 1, wherein said encoding step includes applying the information to the at least one constituent upon completion of said assembling stop.

7. The method of claim 1, wherein said at least one constituent is accessible, at least in part, upon completion of said assembling step.

8. The method of claim 7, wherein the encoded information is decodable without necessitating even partial opening of the assembled container.

9. The method of claim 1 of confining a commodity in a container having a plurality of constituents including an inner envelope directly surrounding the commodity in the assembled container, an outer envelope surrounding the inner envelope, an insert disposed between the inner and outer envelopes of the assembled container, a light-transmitting outermost envelope surrounding the outer envelope of the assembled container, and a tear strip borne by the outermost envelope, wherein said providing step includes applying indicia to each of the inner, outer and outermost envelopes as well as to the insert and to the tear strip.

10. The method of claim 9 wherein said assembling step includes confining the commodity in the inner envelope, thereupon applying the insert around a selected part of the inner envelope, thereafter confining the inner envelope and the insert in the outer envelope, and thereafter applying the outermost envelope, with the tear strip thereon, around the outer envelops.

11. The method of claim 1, wherein said assembling step includes advancing the commodity along a predetermined path and draping the constituents of the container around the advancing commodity in a predetermined sequence in successive portions of said path.

12. The method of claim 1, further comprising the step of processing into said information data pertaining to at least one of (a) the commodity and (b) the container.

13. The method of claim 12, wherein said data denote at least one of the time of the assembling step, the location of the assembling step and at least one person in change of the assembling step.

14. The method of claim 1, wherein said encoding step includes visibly applying said information to an exposed part of at least one constituent of the assembled container.

15. Apparatus for confining successive ones of a series of commodities in composite containers each of which has a set of constituents, comprising:

means for conveying successive commodities of the series along a predetermined path;

means for assembling the constituents of the sets into the containers; including placing the constituents around successive commodities in a predetermined sequence in successive portions of the path;

means for providing at least some constituents of each set with characteristic indicia not later than in the respective portions of said path;

means for processing the characteristic indicia on said at least some constituents of each set into information which is characteristic of each individual assembled container; and means for encoding the information upon each individual container.

16. The apparatus of claim 15, wherein at least some of the characteristic indicia are randomly selected indicia.

17. The apparatus of claim 15, wherein said assembling means comprises a cigarette packing machine.

18. The apparatus of claim 15, wherein said means for providing includes at least one laser.

19. The apparatus of claim 15, wherein said means for providing includes at least one printer.

20. The apparatus of claim 15, wherein the constituents of each set include a first blank for conversion into an inner envelope of a container, a second blank for conversion into an outer envelope of a container, a third blank for conversion into an outermost envelope of a container and an insert for conversion into a collar between the inner and outer envelopes of a container, said providing means including, a first laser for the application of indicia to first blanks, a second laser for the application of indicia to second blanks, a first printer for the application of indicia to inserts and a second printer for the application of indicia to third blanks, said means for encoding including a laser.

21. The apparatus of claim 20, wherein the constituents of each set further include a tear strip borne by the respective third blank, said second printer being arranged to apply indicia to the tear strips.

22. The apparatus of claim 20, further comprising additional conveying means for delivering the blanks and the inserts to the respective portions of said path.

* * * * *